US005921712A

United States Patent [19]

Wokas

[11] Patent Number: 5,921,712

[45] Date of Patent: Jul. 13, 1999

[54] INTEGRATED UNDERGROUND STORAGE RESERVOIR AND ABOVE-GROUND CANOPY AND DISPENSING SYSTEM

[76] Inventor: Albert L. Wokas, 5815 Dew Ct., Rocklin, Calif. 95677

[21] Appl. No.: 08/822,312

[22] Filed: Mar. 21, 1997

[51] Int. Cl.[6] ..... E02D 3/00; E02D 3/16

[52] U.S. Cl. ..... 405/52; 141/59; 405/128; 405/154

[58] Field of Search ..... 405/128, 52, 53, 405/154; 141/59, 65, 7, 98

[56] References Cited

U.S. PATENT DOCUMENTS

| | | | |
|---|---|---|---|
| 2,853,149 | 9/1958 | Grosselin . | |
| 3,193,990 | 7/1965 | Smith . | |
| 3,672,180 | 6/1972 | Davis . | |
| 3,926,230 | 12/1975 | Stary et al. . | |
| 4,010,779 | 3/1977 | Pollock et al. . | |
| 4,095,626 | 6/1978 | Healy | 141/59 X |
| 4,787,772 | 11/1988 | Wagner . | |
| 4,968,179 | 11/1990 | Frahm . | |
| 4,978,249 | 12/1990 | Killman . | |
| 5,037,239 | 8/1991 | Olsen et al. . | |
| 5,244,307 | 9/1993 | Wokas . | |
| 5,301,721 | 4/1994 | Hartmann | 141/59 |
| 5,325,896 | 7/1994 | Koch et al. | 141/59 |
| 5,390,713 | 2/1995 | Fiech . | |
| 5,586,586 | 12/1996 | Fiech | 405/52 X |

*Primary Examiner*—Dennis L. Taylor
*Attorney, Agent, or Firm*—Harness, Dickey & Pierce, P.L.C.

[57] ABSTRACT

An integrated underground storage reservoir and above-ground canopy system is provided. This system comprises a storage reservoir suitable for being buried beneath ground level and suitable for containing a fluid. The integrated system also includes a support system disposed in communication with the reservoir and suitable for projecting above ground level when the reservoir is in a buried condition. The support system preferably includes at least one support member. The integrated system further includes a canopy attached to at least one support member, suitable for providing shelter from weather while accessing the reservoir. In alternative embodiments of this invention, the support system includes support units disposed adjacently to, attached to the exterior of, and disposed within the interior of the underground storage reservoir. The integrated system allows direct access to the storage reservoir, minimizes underground piping and provides enhanced vapor recovery.

18 Claims, 9 Drawing Sheets

INTEGRATED UNDERGROUND STORAGE RESERVOIR AND ABOVE-GROUND CANOPY AND DISPENSING SYSTEM

BACKGROUND OF THE INVENTION

This invention relates generally to underground storage reservoirs in combination with above-ground shelters for accessing such reservoirs, and more particularly relates to an integrated underground fluid storage reservoir and above-ground canopy support system.

Various types of materials are stored beneath the surface of the ground for access through above-ground dispensing and/or distribution facilities. One class of such materials includes fluids such as fuels for automotive and heating uses. Typically, these storage installations include a fluid reservoir that is buried beneath ground level within an excavated pit. A backfill material is typically used to surround the storage tank to achieve a buried condition for the reservoir. Pea gravel is a standard backfill material in the industry because of its ability to quickly achieve a substantially settled condition. Sand has also been used as a backfill material.

In the case of underground storage reservoirs at automobile service stations, one or more reservoirs containing automobile fuel are typically located upon the service station premises at a location some distance away from the pumps used for dispensing the fuel to automobiles. In such an arrangement, the underground storage tanks can be filled, such as by tanker trucks, without impeding the ability of the service station to continue operating. This is because the tanker trucks can access ports or manholes for filling the underground storage tanks in the remote area of the service premises away from the dispensing units.

However, locating underground storage tanks for fluids such as automobile and heating fuels at a distance away from the dispensing location requires a significant amount of underground piping for connecting the dispensing units to the underground storage tanks. These pipes sometimes require maintenance and/or service operations. Therefore, these pipes must be accessible to service and maintenance personnel at times. A typical automobile service station, however, includes one or more sections of concrete driveway covering a substantial portion of the service station premises, in order to provide customers with sufficient maneuvering access to the typical several dispensing units. This substantial concrete driveway also provides sufficient access to the underground storage reservoir filling ports by tanker trucks. This type of arrangement, however, makes accessing the underground piping network connecting the storage tanks with the dispensing pumps expensive, difficult and time consuming.

Automobile service stations are often designed to include multiple dispensing units, commonly referred to as "pumps," "multiple pump dispensers" or "MPDs", from which multiple customers can access the underground storage reservoir or reservoirs at the same time. These dispensing units are often located at multiple service islands located upon the service station premises. Since automobile fuel is commonly sold in multiple grades, the different fuel grades can be stored within a single partitioned reservoir or within multiple reservoirs. Extensive underground piping is therefore typically required in order to distribute different grades of fuel to the different dispensing units located at the various service islands.

In addition, the increasingly popular recovery of fuel vapors from automobile fuel tanks upon filling involves the transport of these vapors to the underground storage reservoir (Phase II recovery). These vapors are subsequently transported to a tanker truck during the next filling of the underground storage reservoir (Phase I recovery). Thus, additional extensive piping would need to be located underground for vapor recovery from the dispensing units located at multiple service islands.

It is also desirable for automobile service stations to provide customers with at least some limited form of shelter from the weather, especially from precipitation. Service stations commonly provide one or more large canopies that extend over a substantial portion of the service station premises, covering the multiple service island locations as well as an extended amount of area surrounding the dispensing pumps. In this manner, service station customers are provided with the convenience of being able to stay dry while fueling, as well as while entering and exiting vehicles. Often, the canopy extends to provide a covered walkway to the service station attendant, who is commonly located within an adjacent service building, such as an automobile service garage or convenience store.

The canopies are typically suspended in place at some distance above the ground through the use of multiple support columns. These columns are often positioned adjacent the dispensing units upon one or more service islands upon the service station premises. Positioning the canopy support columns in this manner allows maximum maneuverability for automobiles upon the service station premises.

A need therefore exists for an improved system whereby the need for extensive underground piping connecting underground fluid storage tanks and dispensing units can be eliminated. A need also exists for a simpler vapor recovery system for use in automobile service stations. A need also exists for an improved, simpler, less expensive system for constructing service station premises.

SUMMARY OF THE INVENTION

The present invention therefore provides an integrated underground storage reservoir and above-ground canopy system. The system includes a storage reservoir suitable for being buried beneath ground level and suitable for containing a fluid. The system also includes a support system including at least one support member that is disposed in communication with, or adjacent to, the reservoir and projects above ground level. Each support member is operable to support one or more canopies for providing shelter from the weather while accessing the reservoir.

More specifically, the integrated system of the present invention comprises an underground storage reservoir for the storage of fuel, such as automobile fuel or heating fuel. The integrated system further includes a support system including at least one support unit disposed in communication with the underground storage tank. In one preferred embodiment, a plurality of support units are disposed in contact with the underground storage reservoir and extend above ground level in a substantially vertical orientation. The present invention may include one or more underground storage reservoirs, any of which may be partitioned to hold more than one type or grade of fluid. In another preferred embodiment, the support system includes multiple support units disposed adjacent to the underground storage tank. The support units are preferably oriented in a generally vertical direction and protrude above the ground level. Thus, the support units are able to support at least one canopy for sheltering the dispensing unit area from weather while accessing the underground storage reservoir or reservoirs.

The present invention also includes a delivery system for delivery of the fluid from within the underground reservoir to above-ground level. Preferably, this includes one or more pipes disposed within the reservoir, which extend in a substantially vertical orientation to an above-ground location directly above the reservoir. The delivery system may also include one or more submersible pumps for delivering fluid from the reservoir to an above-ground location.

The present invention further includes a distribution system for the distribution of fluid from the delivery system. The distribution system may preferably include one or more distribution heads, each located in above-ground communication with one of the submersible pumps. The distribution system also preferably includes a piping network that extends from the distribution heads to one or more dispensing units on an above-ground basis. Most preferably, the piping network is constructed to connect the various distribution units among one or more service islands by being routed through one or more of the canopies, described in more detail below. This piping network may therefore travel vertically from the distribution head or heads to a canopy along the external surfaces of the dispensing units, along the internal surfaces of the dispensing units, or along the support units. The above-ground nature of the distribution system allows easy access for service and maintenance purposes.

It will be appreciated that the present invention is also intended to include those features commonly associated with automobile service stations and fuel delivery stations, as are required for convenience and/or safety. Many of these features, such as venting and vapor recovery provisions, are provided in improved form in accordance with the present invention. While the description herein is intended to emphasize those features of the present invention that are advantages over the prior art, it is not intended to exclude other convenience and/or safety features.

An advantage of the present invention is to provide an integrated system whereby one or more underground storage tanks are located directly beneath an associated delivery and distribution system, thereby minimizing the amount of underground piping network that must be accessed for service and/or maintenance.

Another advantage of the present invention is to provide a integrated system whereby a fluid distribution system is located above ground level, to allow servicing and/or maintenance of the distribution system.

Another advantage of the present invention is to provide a simpler, less expensive system for providing an underground storage reservoir that can be accessed for both delivery and withdrawal while being protected from the weather.

Another advantage of the present invention is to reduce pollution by providing for the recovery of vapors from automobile fuel tanks and from underground storage reservoirs in a manner that is convenient, less expensive, requires a minimum amount of associated underground piping and includes above-ground equipment.

Another advantage of the present invention is to provide an integrated support system for the support of one or more canopies to shelter the accessing of an underground storage reservoir from weather, wherein the support system is disposed in communication with, or adjacent to, the underground storage reservoir.

BRIEF DESCRIPTION OF THE DRAWINGS

Other advantages of the present invention will become apparent to one skilled in the art upon reading the following specification and the following drawings.

DETAILED DESCRIPTION OF THE PREFERRED EMBODIMENT

It should be understood that while this invention is described in connection with particular examples, the scope of the invention need not be so limited. Rather, those skilled in the art will appreciate that the following teachings can be used in a much wider variety of applications than the examples specifically mentioned herein.

Figure 1:
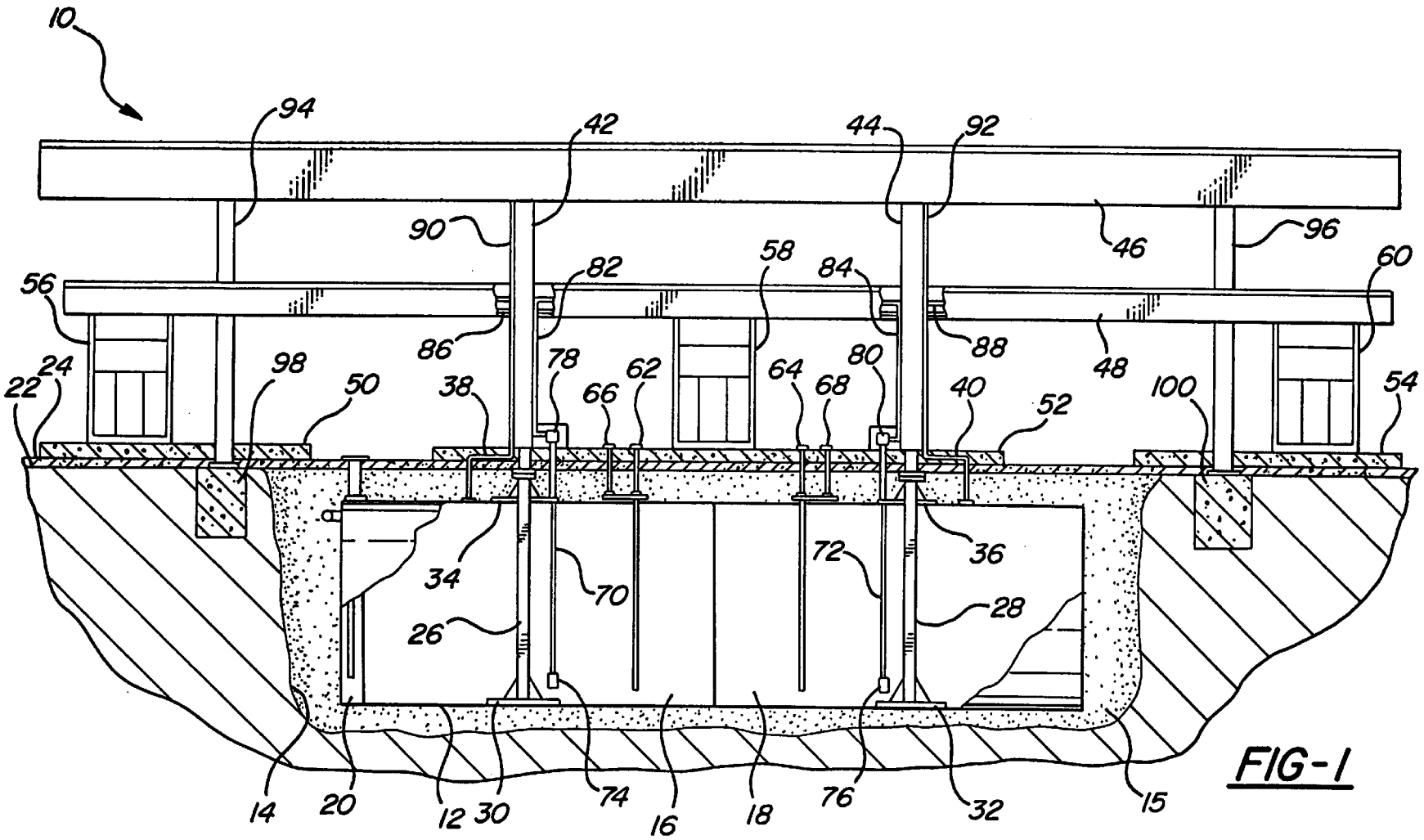
FIG. 1 is a partial cross-sectional view illustrating an integrated underground storage reservoir and canopy support system according to the teachings of a preferred embodiment of the present invention.

Referring now to FIG. 1, there is shown an integrated underground storage reservoir and above-ground canopy support system, generally at 10. The integrated system 10 includes a storage reservoir 12, of the type suitable for being buried below the ground surface, such as in an excavated pit 14. The storage reservoir 12 is suitable for the storage of a fluid, such as automobile fuel, heating fuel or any other type of fluid for which it is advantageous for the fluid to be located underground. The storage reservoir 12 may be of any suitable construction and may be of any suitable size and shape. The storage reservoir 12 shown in FIG. 1 is a 30,000 gallon tank, although it will be realized that any suitable size may be used without departing from the principles of the present invention.

The remainder of the volume within the excavated pit 14 that is not taken by the storage reservoir 12 is preferably filled with a material suitable for supporting the storage reservoir 12, while allowing for drainage around the storage reservoir 12 to occur. Preferably, the backfill material used is pea gravel 15, due to its ability to pack and exhibit a minimum of settling. It will be appreciated that other materials, such as sand, may also be used.

The storage reservoir 12 may be of a single-compartment or a multi-compartment design. In the embodiment shown in FIG. 1, the storage reservoir 12 is provided to include two compartments, namely, a first compartment 16 and a second compartment 18. These two compartments are disposed horizontally relative to each other, although it will be realized that any suitable compartment arrangement may also be used. Multi-compartment designs for the storage reservoir 12 may be utilized for the storage of multiple grades of automobile fuel, as is commonly done at gasoline service stations. The storage reservoir 12 may also typically include an oil-water separator 20, of a size and at a location suitable for achieving the desired separation effect.

The storage reservoir 12 is preferably located substantially completely beneath the ground surface, designated by the numeral 22. In the embodiment shown in FIG. 1, representative of a automobile service station, a concrete driveway 24 is commonly located upon the ground surface 22 over a substantial surface area of the service station premises.

The integrated system 10 also includes a support system that is disposed in communication with, or adjacent to, the storage reservoir 12. The support system is suitable for projecting above the ground level when the reservoir is in a buried condition within the ground. In the embodiment shown in FIG. 1, the support system includes a first support unit 26 and a second support unit 28. As shown in FIG. 1, the first and second support units 26 and 28 extend within, and are supported in part by, the storage reservoir 12. In one preferred embodiment, these support units are attached directly to the surfaces of the storage reservoir 12. As shown in FIG. 1, the first and second support units 26 and 28 are attached directly to the lower interior surface of the storage reservoir 12 through the use of bearing plates 30 and 32. The bearing plates 30 and 32 are attached to the surface of the storage reservoir 12 through a suitable method such as welding. In similar manner, the first and second support units 26 and 28 are also attached directly to the upper exterior surface of the storage reservoir 12, through the use of bearing plates 34 and 36. These bearing plates are also attached directly to the surface of the storage reservoir 12 by any suitable means, such as by welding. It will be appreciated that the first and second support units 26 and 28 may be attached to the surfaces of the storage reservoir 12 through any suitable means, and at locations other than those described in connection with FIG. 1.

The first and second support units 26 and 28 are also shown to include canopy support platforms 38 and 40 disposed at or about ground level. These canopy support platforms assist in stabilizing the upper portions of the first and second support units 26 and 28, as well as the canopy structure which will be described in greater detail below. As shown in FIG. 1, the first support unit 26 and the second support unit 28 extend above the ground surface 22 over a distance sufficient for supporting one or more canopy units at the desired height. Although the first and second support units 26 and 28 are shown to be of a generally vertical configuration, it will be realized that these support units may take on any suitable construction and configuration that may be suitable for achieving the desired support. The above-ground portions of the first and second support units 26 and 28 may optionally be covered in any suitable way, to provide an aesthetic appearance for the support units. As shown in FIG. 1, the first support shroud 42 and second support shroud 44 cover the first and second support units 26 and 28, respectively. These shrouds may also be suitable for concealing any piping networks or venting apparatus that accompany the components of the integrated system 10 as described herein. One example of such a piping system is shown in U.S. Pat. No. 5,244,307, entitled "Anti-pollution Piping and Dispensing System", issued to the present inventor, and incorporated by reference herein.

With reference still to FIG. 1, the first support unit 26 and second support unit 28 of the integrated system 10 are operable for supporting at least one canopy for providing shelter from the weather while accessing the storage reservoir 12. In the embodiment shown in FIG. 1, the support units 26 and 28 operate to support two canopies, namely, a primary canopy 46 and a secondary canopy 48. The primary canopy 46 is typically large enough to provide shelter for service station customers accessing the storage reservoir 12 from any of the service islands 50, 52 or 54. The primary canopy 46 is also typically large enough to shelter vehicles parked adjacent the service islands. In this arrangement, service station customers can exit and enter their vehicles within the protection of the canopy. Extended coverage for the primary canopy 46 is also advantageous because it still allows the primary canopy 46 to provide shelter from wind-blown precipitation. Further, the primary canopy 46 may extend to provide a covered walkway for customers from the service islands 50, 52 and 54 to the location of the service station attendant, which may be inside an adjacent service garage or convenience store located upon the service station premises. The primary canopy 46 is preferably located at a height above the ground surface 22 so as to allow tall vehicles, such as trucks, to be positioned beneath the primary canopy 46.

In the preferred embodiment shown in FIG. 1, a secondary canopy 48 is also provided. The secondary canopy 48 may preferably be of a size smaller than that of the primary canopy 46. As shown in FIG. 1, the secondary canopy 48 is of a length less than that of the primary canopy 46. In addition, the secondary canopy 48 is constructed of a width similar to that of any of the dispensing units 56, 58 and 60 located upon the service islands 50, 52 and 54. This positioning of the secondary canopy 48 allows the piping network associated with the distribution system to be located within the secondary canopy 48, as will be described in greater detail below. It will be appreciated that this arrangement for the primary canopy 46 and the secondary canopy 48 is only one of many suitable arrangements. For example, the primary canopy 46 can also contain piping associated with the distribution system.

The service islands 50, 52 and 54 are typically provided on service station premises as a raised surface for the protection of the dispensing units 56, 58 and 60 from damage and moisture. However, it will be appreciated that in other embodiments, the service islands 50, 52 and 54 may be located along the same level as the concrete driveway 24. The dispensing units 56, 58 and 60 may be of any suitable type for the dispensing of fluid from the storage reservoir 12. In the embodiment shown in FIG. 1, the dispensing units 56, 58 and 60 are of a type commonly seen at automobile service stations for the dispensing of multiple grades of automobile fuel. As such, the dispensing units may include pumps which dispense fuel from within the storage reservoir 12.

One advantage of the integrated system 10 involves access to the components of the system at a single, sheltered location. As previously mentioned, this type of arrangement eliminates the need for extensive underground piping systems which are subject to service and/or maintenance. No underground piping is thus required in this system for feeding the dispensing units. Also as part of this arrangement, the storage reservoir 12 is shown to include at least one filling line located within the protection of the canopy. In the embodiment shown in FIG. 1, the storage reservoir 12 includes two filling lines 62 and 64 for filling the first compartment 16 and the second compartment 18 of the storage reservoir 12. The storage reservoir 12 also includes vapor recovery ports 66 and 68, also associated with the first compartment 16 and the second compartment 18. The vapor recovery ports 66 and 68 are typical in the automobile fuel industry for allowing the recovery of fuel vapors (a Phase I recovery) from within the storage reservoir 12 when the storage reservoir 12 is filled. Thus, another advantage of the present invention is the ability of the integrated system 10 to provide enhanced pollution control through minimum piping for vapor recovery as well.

The integrated system 10 also includes a delivery system for the delivery of fluid from within the storage reservoir 12 to an above-ground location. In the embodiment shown in FIG. 1, the delivery system includes discharge lines 70 and 72 with associated submersible pumps 74 and 76. Automobile fuel stored within the first compartment 16 and the second compartment 18 is pumped by the submersible pumps 74 and 76 through the discharge lines 70 and 72 to the distribution heads 78 and 80. For convenience, the distribution heads 78 and 80 are shown to be located atop the service island 52, near the filling lines 62 and 64. In such an arrangement, the operating equipment of the integrated system 10 is centrally located for convenient access. Alternatively, it will be appreciated that any suitable location for the filling lines, the vapor recovery ports and the components of the delivery system may be used. For example, the distribution heads 78 and 80 may be located within the primary canopy 46 or the secondary canopy 48. This type of arrangement removes the distribution heads from upon the service islands, for enhancing appearance of the integrated system 10 as a whole. It will be appreciated that this, and any other alternate arrangements, are available for any of the embodiments described herein.

The integrated system 10 also includes a distribution system for the distribution of fluid from the storage reservoir 12 that is brought to the surface by the delivery system. The purpose of the distribution system, therefore, is to distribute fluid from the storage reservoir 12 as may be required through an above-ground arrangement. One advantage of the distribution system of the present invention is that it provides above-ground piping networks that can be easily serviced and maintained as necessary, without excavation of underground piping networks in previous systems. The distribution system is shown to include distribution lines 82, 84, 86 and 88. These distribution lines provide means for the transport of fuel from the distribution heads 78 and 80 to the dispensing units 56, 58 and 60. In the embodiment shown in FIG. 1, the distribution lines 82 and 84 travel in a generally vertical direction upon the first support unit 26 and second support unit 28 to the secondary canopy 48. The distribution lines 86 and 88 are connected to the distribution lines 82 and 84 and allow for the transport of fuel to the dispensing units 56, 58 and 60. As shown in FIG. 1, the distribution lines 86 and 88 are located within the secondary canopy 48. It will be realized that in alternative embodiments, any suitable above-ground arrangement for the distribution lines may be used, including locating these lines at least in part within the primary canopy. The secondary canopy 48 may be of sufficient size to allow the distribution system to reach other service islands. Alternatively, the secondary canopy may only be of a size sufficient for the distribution system to be routed to other service islands in a single row. In such a situation, the lines of the distribution system for feeding other service islands disposed in adjacent rows can be placed within the primary canopy 46. In yet another embodiment, where the secondary canopy is discontinuous along a single row of service islands, the piping of the distribution system is also routed through the primary canopy 46.

The distribution system also includes vents 90 and 92 which provide an air source for the storage tank 12 when fluid is withdrawn from the storage reservoir 12. The vents 90 and 92 typically each include a check valve (not shown) so that vapors from within the storage reservoir 12 are not vented to the atmosphere.

The integrated system 10 may also include additional support units for maintaining the support of large primary and/or secondary canopies relative to the ground. In the embodiment shown in FIG. 1, the integrated system 10 includes auxiliary support units 94 and 96 disposed adjacent the service islands 50 and 54. The auxiliary support units 94 and 96 are anchored by concrete footings 98 and 100 for stabilization purposes. It will be appreciated that the auxiliary support units may be disposed at any location suitable for supporting the primary and/or secondary canopies, and may also be anchored or otherwise supported in any suitable way for achieving the desired support.

Figure 2:
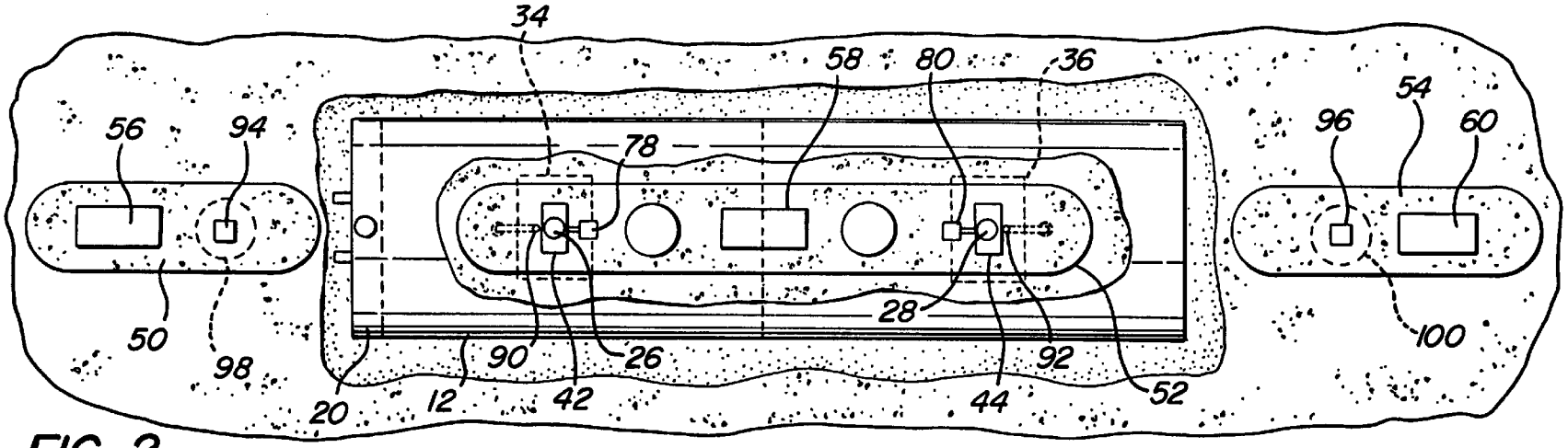
FIG. 2 is a plan view of the underground storage reservoir, and canopy support system shown in FIG. 1.

Referring now to FIG. 2, there is shown a plan view of the embodiment shown in FIG. 1. From this perspective, the relationship between the underground storage reservoir 12 and the service islands 50, 52 and 54 is shown. This view illustrates the convenience of the integrated system 10 of the present invention. As can be seen in FIG. 2, all of the primary components of the integrated system 10 are located in a convenient, central and sheltered location, with a minimum of piping located beneath ground level.

Figure 3:
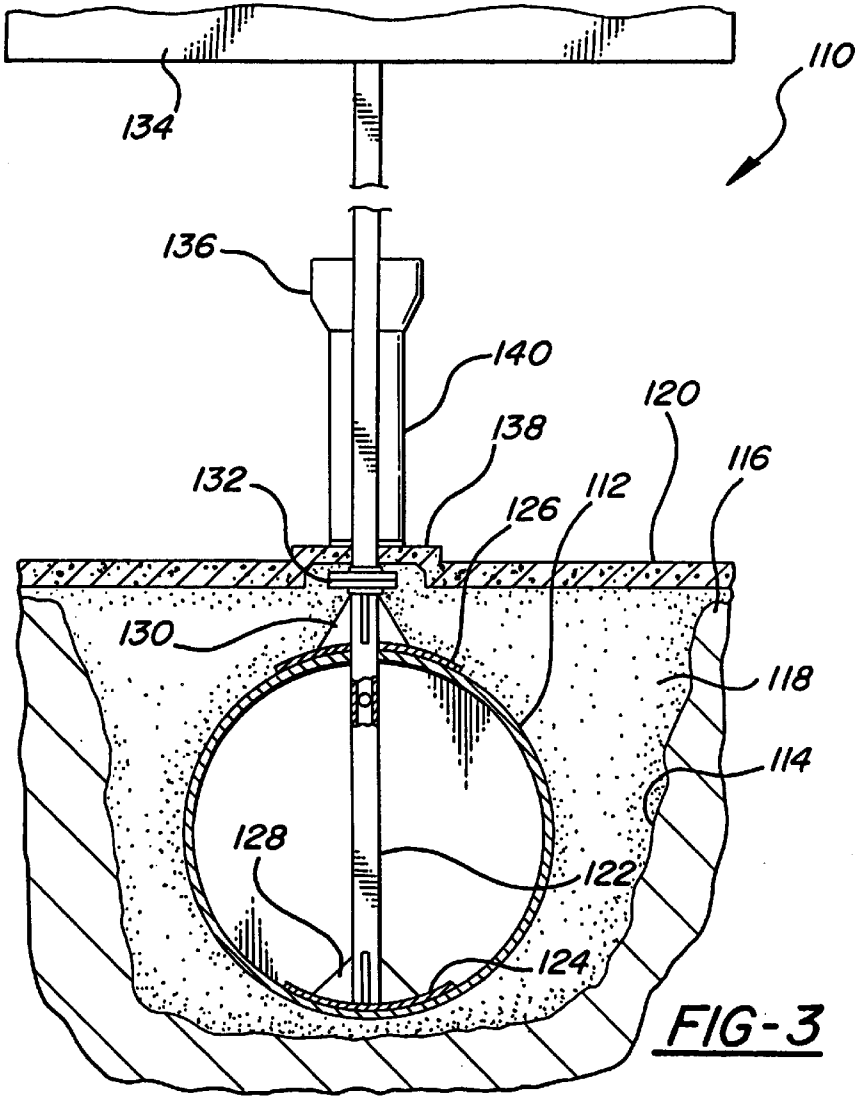
FIG. 3 is a cross-sectional view illustrating an underground storage reservoir having a support unit disposed therewithin for supporting a canopy, according to the teachings of a preferred embodiment of the present invention.

Referring now to FIG. 3, there is shown a cross-sectional view of an integrated system 110 according to a preferred embodiment of the present invention. The integrated system 110 is similar in many respects to the integrated system 10 shown in connection with FIGS. 1 and 2. The integrated system 110 is shown to include a storage reservoir 112. In this embodiment, the storage reservoir 112 is shown to be of a substantially circular cross-section, although it will be appreciated that any suitable shape or size may be used. The storage reservoir 112 is substantially buried within an excavated pit 114 located below the ground surface 116, in similar manner as before. The remainder of the volume within the excavated pit 114 that is not taken by the storage reservoir 112 is preferably filled with a material suitable for supporting the storage reservoir 112, while allowing for drainage around the storage reservoir 112 to occur. In the embodiment shown in FIG. 3, pea gravel 118 surrounds the storage reservoir 112 within the excavated pit 114. In similar manner as before, a concrete driveway 120 is disposed above the ground surface 116 in the embodiment shown in FIG. 3, indicative of a service station premises.

The integrated system 110 is shown to include a support unit 122, disposed in a substantially vertical direction, within the storage reservoir 112, and projecting above the ground surface 116, in similar manner as before. The support unit 122 includes means for engaging the storage reservoir 112. In the embodiment shown in FIG. 3, this is provided as a lower bearing plate 124 having a substantially circular cross-section to match the lower interior surface of the storage reservoir 112. Accordingly, the lower bearing plate 124 is preferably attached to the interior lower surface of the storage reservoir 112, through means such as welding. The support unit 122 is also shown to include an upper bearing plate 126, also having a substantially circular cross-section. The upper bearing plate 126 is attached to the upper exterior surface of the storage reservoir 112, such as by welding or the like. The lower bearing plate 124 and the upper bearing plate 126 are shown to include gussets 128 and 130 for providing reinforcement between the support unit 122 and the lower and upper bearing plates 124 and 126. It will be appreciated that any suitable support structure may be used to reinforce the connection between the support unit 122 and the lower and upper bearing plates 124 and 126.

The support unit 122 is shown to include a canopy support platform 132, for stabilization purposes, in similar manner as before. The integrated system 110 includes a primary canopy 134 and a secondary canopy 136, each of which are supported at least in part by the support unit 122. The support unit 122 is shown to pass through a service island 138, which assists in its support. A dispensing unit 140 is located atop the service island 138 for dispensing fluid from within the storage reservoir 112. In similar manner as before, the secondary canopy 136 may include the piping elements of the dispensing system (not shown), as previously described.

Figure 4:
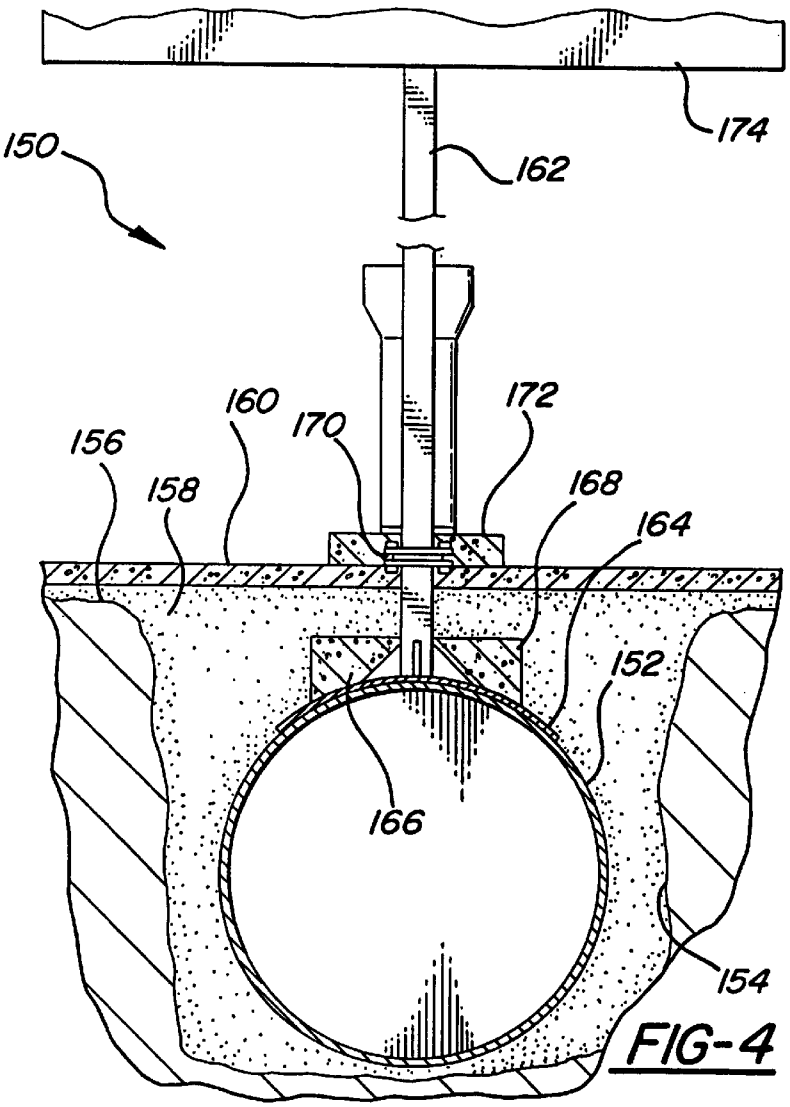
FIG. 4 is a cross-sectional view of an underground storage reservoir and a support unit disposed in communication therewith, for supporting an above-ground canopy, according to the teachings of another preferred embodiment of the present invention.

With reference now to FIG. 4, there is shown another preferred embodiment of the present invention in cross-section. An integrated system 150 is provided in similar form to the integrated systems previously described. In this arrangement, a storage reservoir 152 is located within an excavated pit 154 below the ground surface 156. Pea gravel 158 surrounds the storage reservoir 152, and a concrete driveway 160 is disposed above the ground surface 156 in similar manner as before.

In this arrangement, however, a support unit 162 is provided, which does not extend through the storage reservoir 152. Instead, the support unit 162 is attached to the upper exterior surface of the storage reservoir 152 and is reinforced for stability. The support unit 162 includes an upper bearing plate 164, that is of substantially circular cross-section for substantially matching the upper surface of the storage reservoir 152. In similar manner as before, gussets 166 are used to reinforce the connection between the support unit 162 and the upper bearing plate 164. The upper bearing plate 164 may preferably be attached to the storage reservoir 152 by welding or other suitable method. To provide reinforcement between the support unit 162, the storage reservoir 152, the gussets 166 and the surrounding pea gravel 158, a concrete footing 168 is provided. The concrete footing is applied to substantially surround the connection between the support unit 162 and the storage reservoir 152. In such an arrangement, the concrete footing 168 provides an anchor for the support unit 162 and also stabilizes the support unit 162 within the pea gravel 158.

The support unit 162 is further shown to include a canopy support platform 170, in similar manner as before. The canopy support platform 170 is located at approximately the same level as the service island 172, also in similar manner as before. In this arrangement, a single canopy, designated by the numeral 174, is suspended above the ground surface 156 by the support unit 162.

Figure 5:
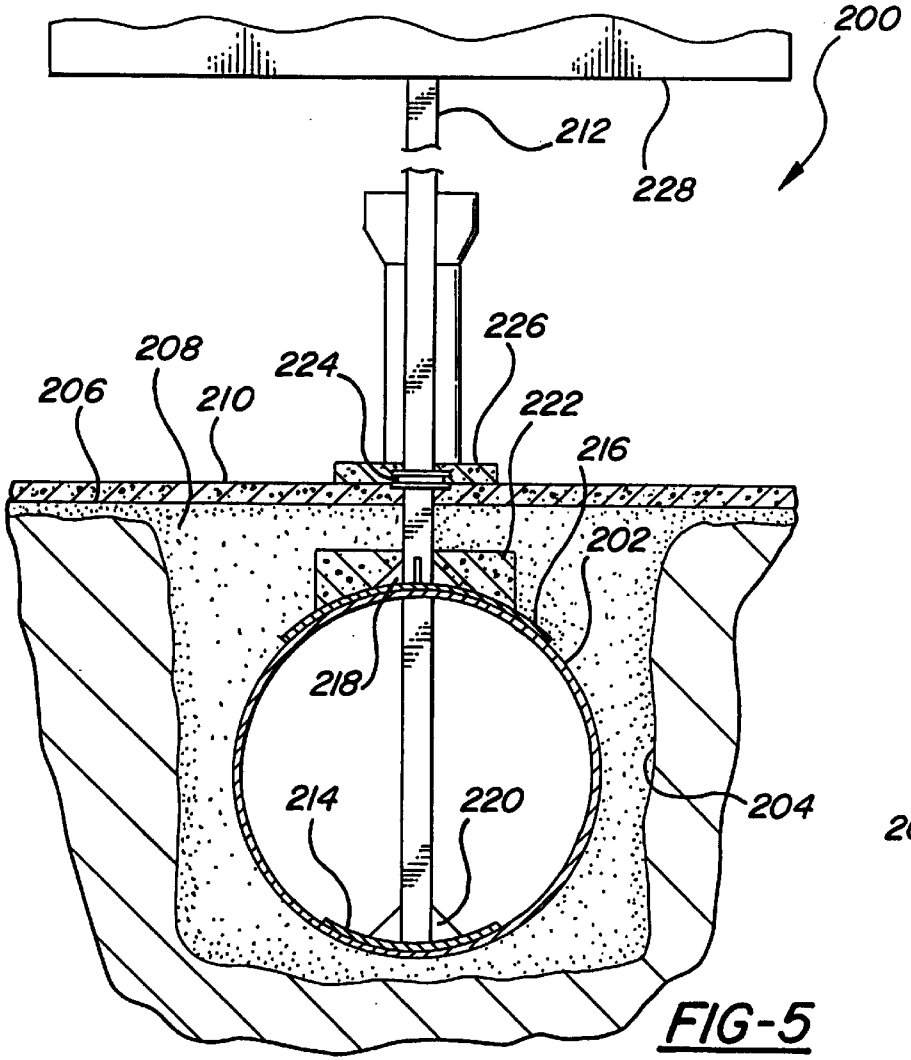
FIG. 5 is a cross-sectional view illustrating an underground storage reservoir with a support unit disposed therethrough, for supporting an above-ground canopy, according to the teachings of another preferred embodiment of the present invention.

Another preferred embodiment of the present invention is provided in FIG. 5. This figure shows the concrete reinforcement arrangement of FIG. 4, with the extension of the support unit through the storage reservoir, as in FIG. 3. More specifically, FIG. 5 shows an integrated system 200, including a storage reservoir 202 buried within an excavated pit 204 below the ground surface 206, and surrounded by pea gravel 208, as before. A concrete driveway 210, indicative of a service station premises, is also shown. In this arrangement, however, the support unit 212 extends through the interior of the storage reservoir 202. As such, the support unit 212 includes a lower bearing plate 214 that is attached to the lower internal surface of the storage reservoir 202 by welding or the like. An upper bearing plate 216 is attached to the upper external surface of the storage reservoir 202, also in similar manner as before. Gussets 218 and 220 are provided for reinforcing the connection between the support unit 212 and the lower and upper bearing plates 214 and 216, as before. A concrete footing 222 is provided, in similar manner as is shown in FIG. 4, for stabilizing and for providing an anchor for the support unit 212.

It will therefore be appreciated that varying configurations may exist for the support units and any concrete footing that may be used for providing the desired stabilization and anchoring effect. It will also be appreciated that concrete footings may be provided at other locations as may be suitable or necessary to achieve any desired stabilization and/or anchoring. In addition, the concrete footing 222 may be increased in size and weight in order to provide greater stabilization in the arrangement where two canopies are used.

The support unit 212 shown in FIG. 5 includes a canopy support platform 224 that extends through a service island 226. The support unit 212 is shown to extend above the ground surface 206 for supporting a canopy 228. In this embodiment, a single canopy design is shown; however, it will be realized that a multiple canopy assembly can also be used.

Figure 7:
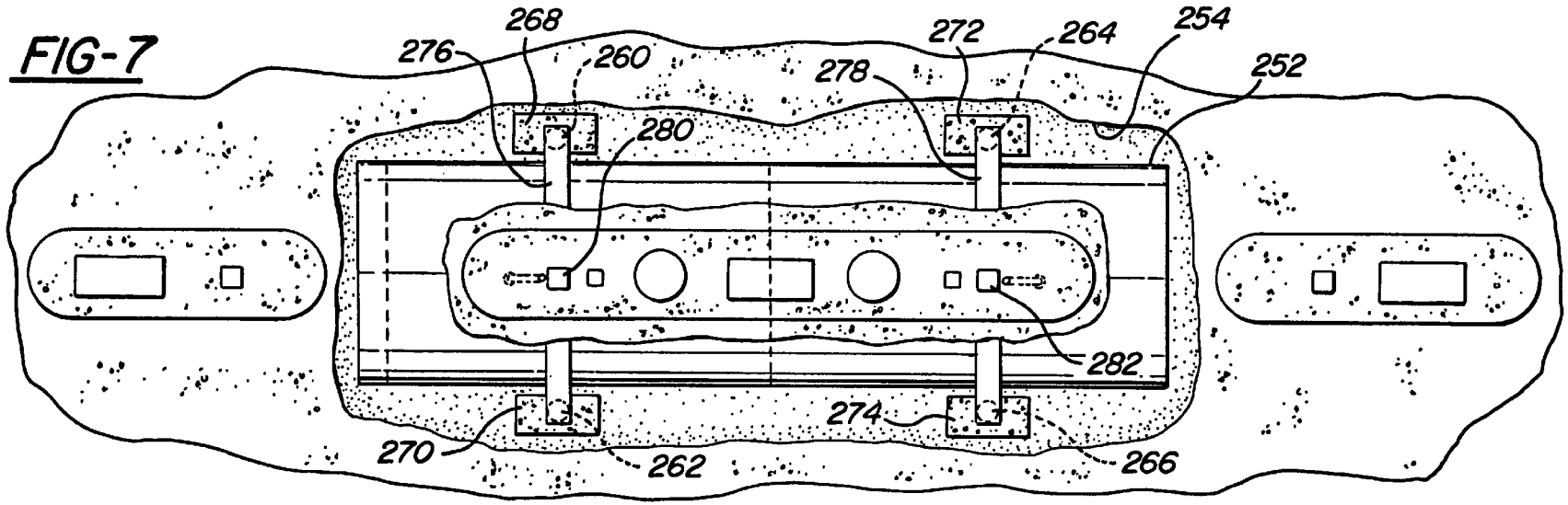
FIG. 7 is a plan view of the underground storage reservoir and support system shown in FIG. 6.
Figure 6:
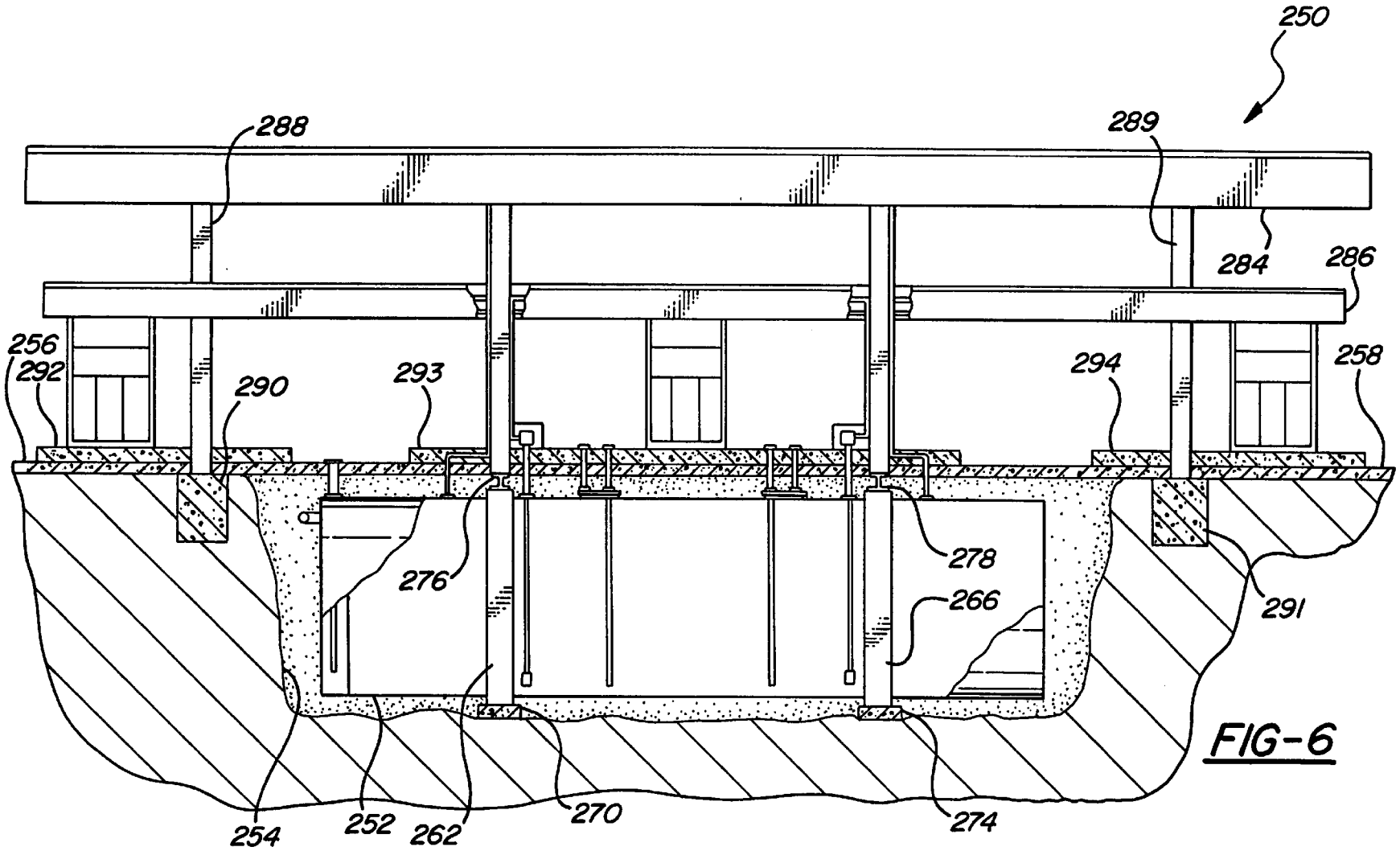
FIG. 6 is a partial cross-sectional view illustrating another preferred embodiment of the present invention, including an underground storage reservoir and a support system disposed adjacent thereto, for supporting a canopy.

Referring now to FIG. 6, there is shown an integrated system 250 in accordance with yet another preferred embodiment of the present invention. The integrated system 250 is shown to include a storage reservoir 252 located in an excavated pit 254 below the ground surface 256, with a concrete driveway 258 covering the ground surface 256, in similar manner as before. In this embodiment, however, the support system is disposed adjacent to the storage reservoir 252. As shown in FIGS. 6 and 7, the support system includes a plurality of support posts 260, 262, 264 and 266 disposed adjacent the storage reservoir 252. The support posts may preferably be of the type filled with concrete, and are anchored by concrete footings 268, 270, 272 and 274, located beneath the storage reservoir 252 at both sides. A pair of support beams 276 and 278 are disposed above the storage reservoir 252 and are supported by the support posts 260, 262, 264 and 266.

The support system shown in FIGS. 6 and 7 also includes support units 280 and 282. These support units are disposed upon the central portions of the support beams 276 and 278, and they project above the ground surface for supporting an above-ground canopy system. In this arrangement, a primary canopy 284 and a secondary canopy 286 are provided, in similar manner as in FIG. 1. Alternatively, it will be recognized that any suitable canopy arrangement may be used. The primary and secondary canopies are also supported by auxiliary support units 288 and 289, which are anchored by concrete footings 290 and 291, respectively, in a similar manner as described in connection with FIG. 1. Also in a similar manner, the support units 280 and 282 and the auxiliary support units 288 and 289 are secured in a substantially stationary position by being disposed within the concrete making up the service islands 292, 293 and 294.

The remaining components of the integrated system 250, including those comprising the delivery system, distribution system, dispensing units and venting system, are substantially similar to those components described in connection with FIG. 1. Therefore, they are not described in detail again here.

Figure 8:
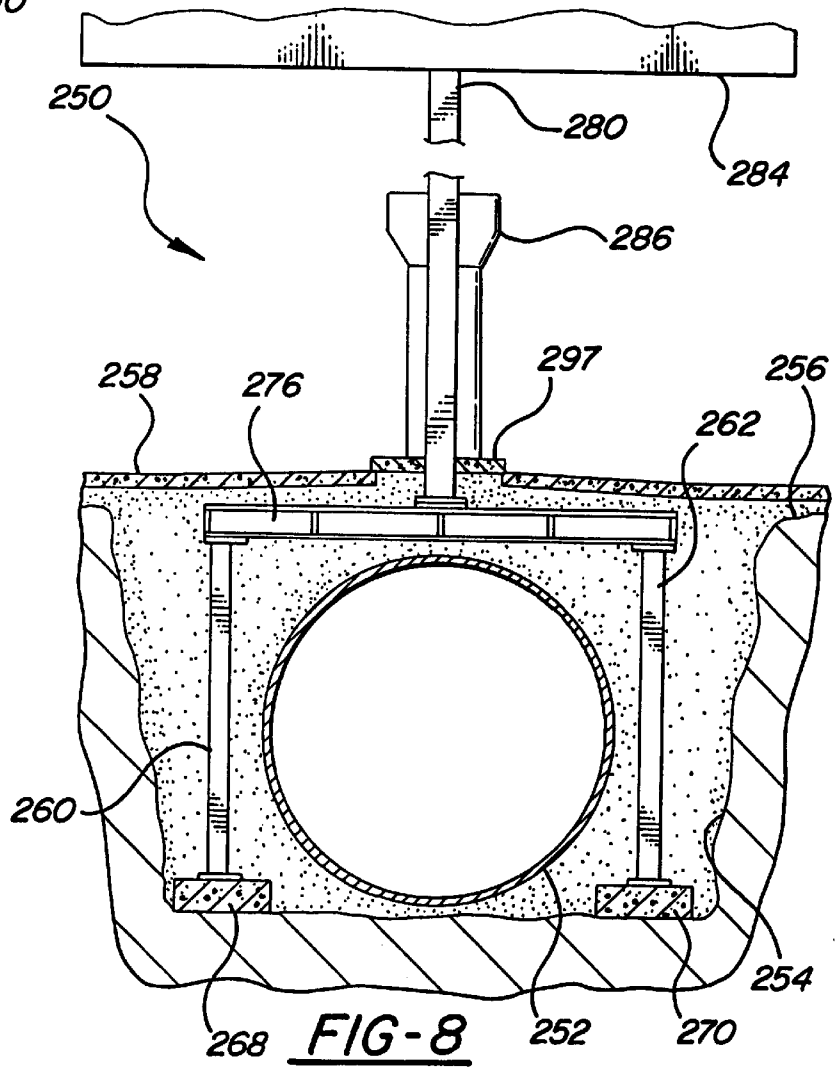
FIG. 8 is a cross-sectional view showing an underground storage reservoir and an adjacently disposed canopy support system, according to another preferred embodiment of the present invention.
Figure 10:
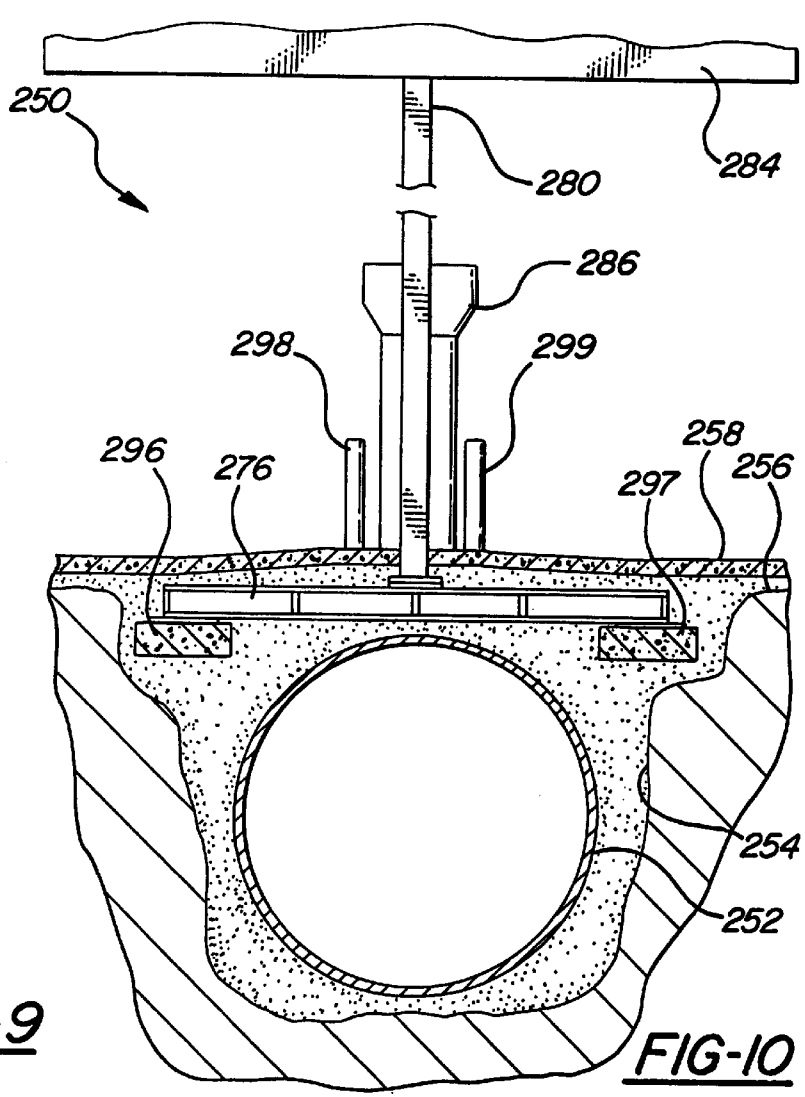
FIG. 10 is a cross-sectional view illustrating an underground storage reservoir and an adjacently disposed canopy support system according to yet another preferred embodiment of the present invention.
Figure 9:
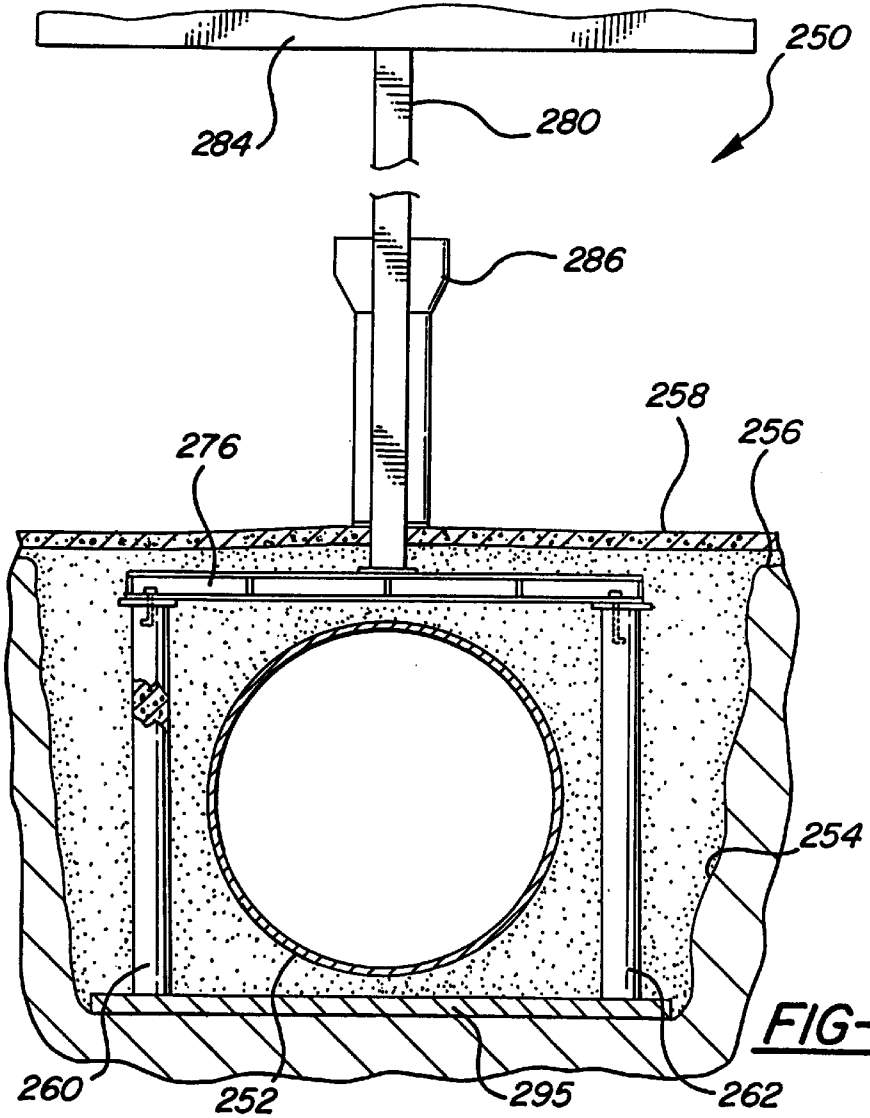
FIG. 9 is a cross-sectional view showing an underground storage reservoir and an adjacently disposed canopy support system, according to yet another preferred embodiment of the present invention.

With reference now to FIGS. 8, 9 and 10, there are shown three different embodiments of support systems, wherein each support system is disposed adjacent to, but substantially not in contact with, the underground storage reservoir. Since FIG. 8 shows a cross-sectional view including substantially the same components shown in FIGS. 6 and 7, like reference numerals will be used to describe these components in FIG. 8. FIG. 8 is shown to include an integrated system 250 having a storage reservoir 252 located within an excavated pit 254, with a concrete driveway 258, as previously described. Support posts 260 and 262 extend vertically above concrete footings 268 and 270 located at the bottom of the excavated pit 254. In this arrangement, the support posts 260 and 262 suspend the support beam 276 above the upper surface of the storage reservoir 252. Thus, a support system is created wherein the support system components are substantially free from contact with the storage reservoir 252. A support unit 280 is shown to project above the ground surface from the center of the support beam 276 for supporting the primary canopy 284 and secondary canopy 286. The service island 297 also provides additional support for the support unit 280.

Referring now to FIG. 9, a similar arrangement is shown for the support system. In this arrangement, however, the concrete footings 268 and 270 are replaced by a concrete slab 295 that is disposed at the floor of the excavated pit 254. This arrangement may provide additional support for the storage reservoir 252. In addition, FIG. 9 shows that the service islands are no longer in a raised condition above the concrete driveway 258.

Referring now to FIG. 10, there is shown another version of the integrated system 250. In this arrangement, the support beam 276 is supported directly by concrete footings 296 and 297, instead of by the support posts 260 and 262 described in connection with FIGS. 8 and 9. In addition, bumper guards 298 and 299 have been added to protect the support units and dispensing units from damage.

Figure 11:
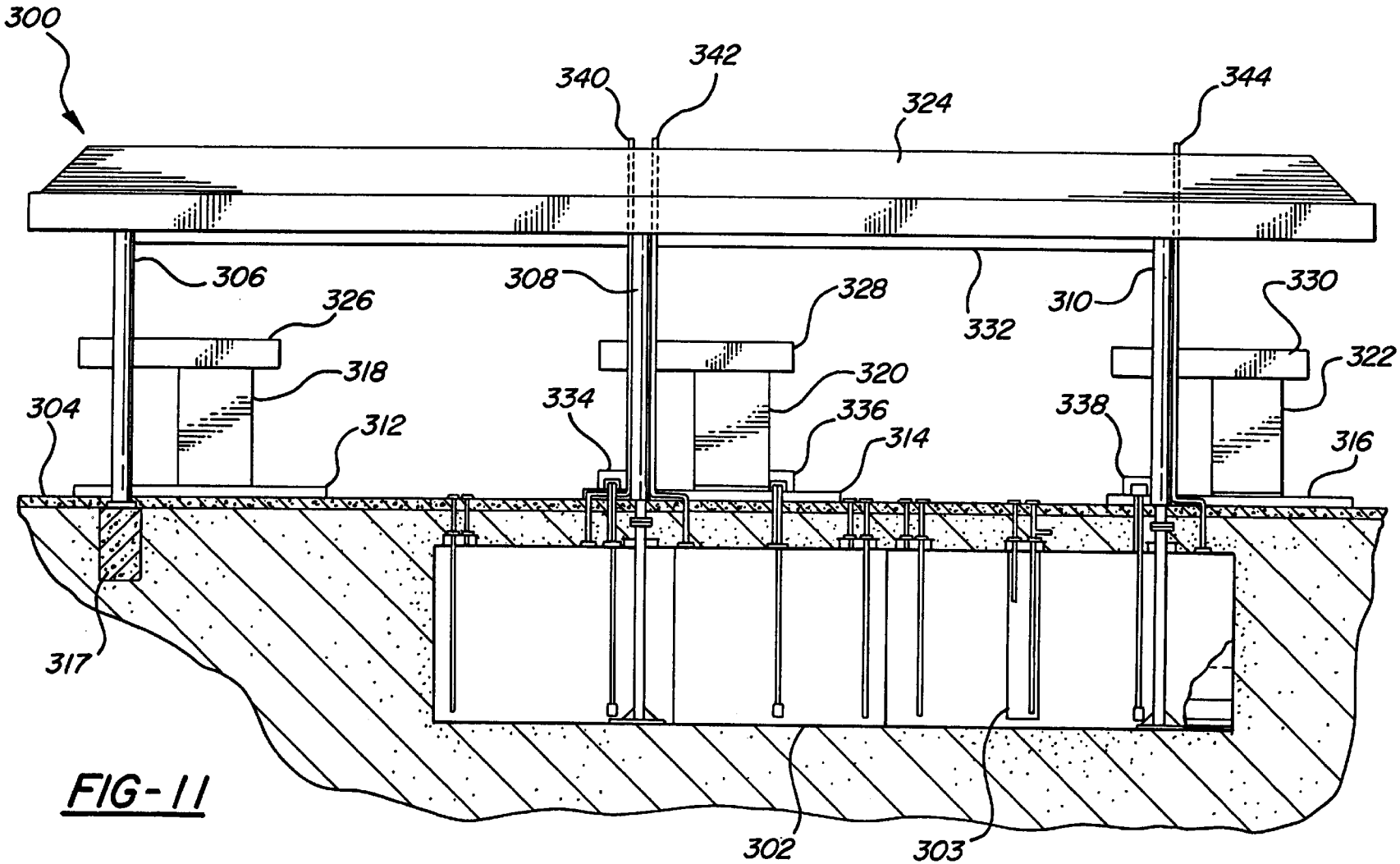
FIG. 11 is a cross-sectional view illustrating an underground storage reservoir and an adjacently disposed canopy support system according to yet another preferred embodiment of the present invention.

With reference now to FIG. 11, there is shown another preferred embodiment according to the present invention. FIG. 11 shows an integrated system generally at 300. The integrated system 300 includes a storage reservoir 302 that is buried beneath ground level, and includes an oil-water separator 303. A concrete driveway 304 is again shown. In this arrangement, however, the integrated system 300 includes support units 306, 308 and 310 that are anchored within service islands 312, 314 and 316, respectively, by concrete footing 317 and within the reservoir 302, as shown, in similar manner as before. Dispensing units 318, 320 and 322 are located upon the service islands 312, 314 and 316, respectively.

A primary canopy 324 is provided in this arrangement, while the secondary canopy present in the previously described embodiments is now divided into three secondary canopy sections, designated 326, 328 and 330. In this arrangement, a pipe race 332 is provided between the support units 306, 308 and 310 for containing the various lines of the distribution system, since the secondary canopy is of a discontinuous arrangement in this embodiment. Since the storage reservoir 302 is shown to be of a three-compartment design, three distribution heads 334, 336 and 338 are provided to access the three compartments. Accordingly, the distribution piping (not shown) may now be disposed within or upon the support units 306, 308 and 310 as well as through the pipe race 332. In this arrangement, fluid from the storage reservoir 302 is transported up to the primary canopy 324 and then down any of the respective support units for distribution to any of the dispensing units 318, 320 or 322. It will be appreciated, as before, that the piping of the distribution system may be disposed either within or upon the outside of the support units 306, 308 and 310. Suitable shrouds or other coverings may be desired to cover externally-located piping upon the support units to provide an aesthetic appearance. In addition, vents 340, 342 and 344 are provided for the individual compartments of the storage reservoir 302, as before.

Figure 12:
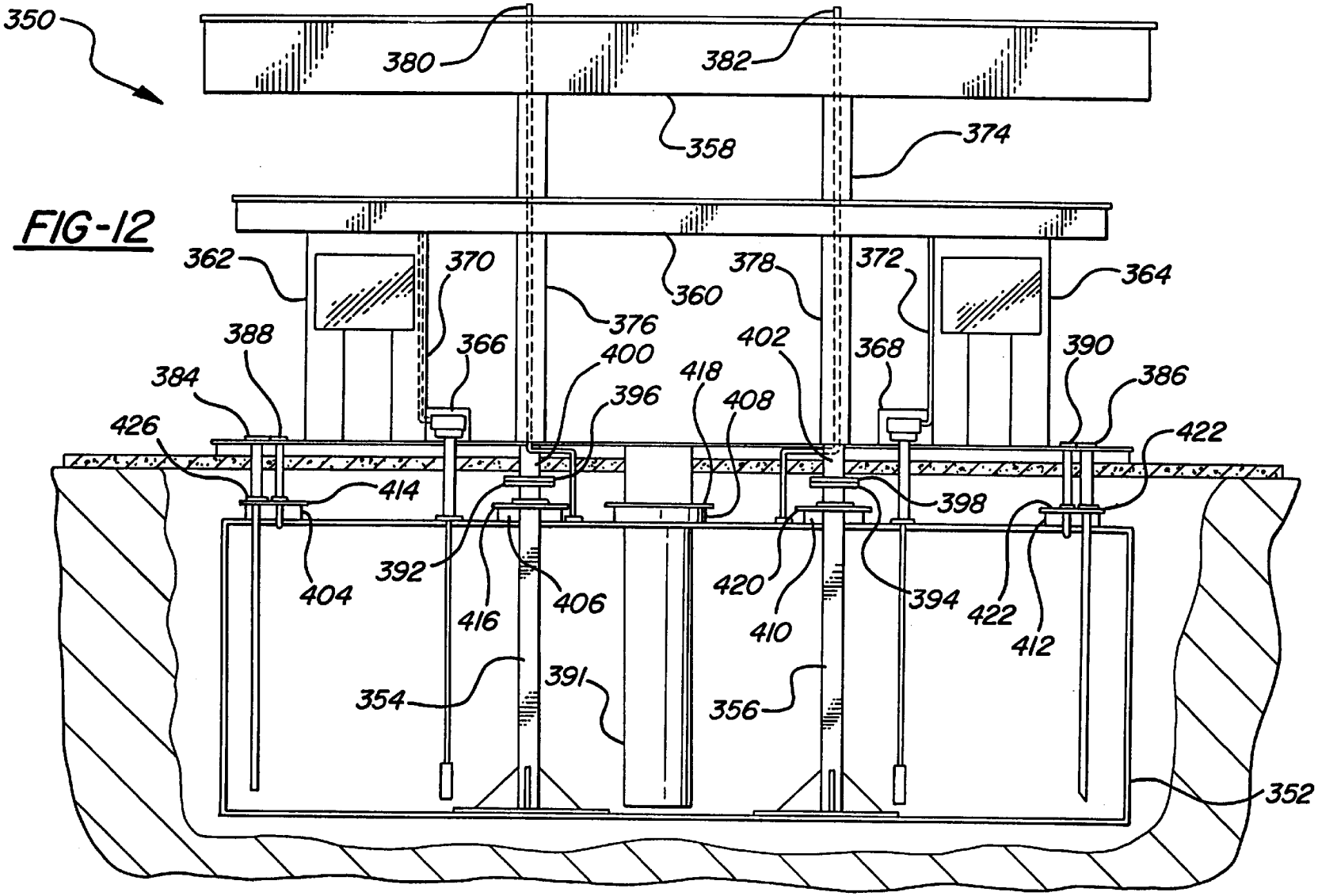
FIG. 12 is a cross-sectional view illustrating an underground storage reservoir and an canopy support system disposed in communication with the underground storage reservoir according to yet another preferred embodiment of the present invention.

Referring to FIG. 12, there is shown yet another preferred embodiment of the present invention. FIG. 12 shows an integrated system 350 including a storage reservoir 352, with support units 354 and 356 extending through the interior of the storage reservoir 352 and above ground level. The support units 354 and 356 support a primary canopy 358 and a secondary canopy 360. In this arrangement, however, the dispensing system is of a different configuration. The integrated system 350 includes a first dispensing unit 362 and a second dispensing unit 364, to which a first distribution head 366 and a second distribution head 368 are connected, to provide fluid from within the storage reservoir 352. The distribution heads 366 and 368 are located near the first and second dispensing units 362 and 364, so that the lines of the distribution system, namely, the first distribution line 370 and the second distribution line 372, can be disposed directly along the dispensing units. This arrangement provides an enhanced aesthetic appearance. As shown in FIG. 12, these distribution lines can be located either within or upon the exterior surface of the dispensing units. For example, the first distribution line 370 is disposed within the interior of the first dispensing unit 362, while the second distribution line 372 is disposed upon the exterior surface of the second dispensing unit 364. The distribution lines can then be routed through the secondary canopy 360 to distribute fluid from the storage reservoir 352 among multiple dispensing units connected by the same secondary canopy. In addition, this distribution system allows adjacent service islands to be connected through a distribution system that passes through the primary canopy 358. A third distribution line 374 is shown to be disposed between the secondary canopy 360 and the primary canopy 358 for this purpose.

In this embodiment, a first support shroud 376 and second support shroud 378 are disposed upon the above-ground portions of the support units 354 and 356 to provide an aesthetic appearance. The support shrouds, as used in any embodiment described herein, may contain any piping networks or venting apparatus. Accordingly, as shown in FIG. 12, vents 380 and 382 are disposed within the first and second support shrouds 376 and 378, to allow air to enter the storage reservoir 352 as it is emptied.

The embodiment shown in FIG. 12 also includes alternative arrangements for the filling lines 384 and 386 and accompanying vapor recovery ports 388 and 390. These are shown to be located laterally relative to the dispensing units, as opposed to the central location previously described. It will therefore be appreciated that the filling lines and vapor recovery ports can be located at any suitable position. The reservoir 352 is also shown to include an oil-water separator 391, as before.

The support units 354 and 356, like the support units described throughout, may preferably be provided as a two-piece assembly, wherein the portions designated 354 and 356 are the lower portions disposed within the storage reservoir 352. The support units 354 and 356 preferably include support covers 392 and 394, which are suitable for attachment by any suitable means, such as by welding, to the lower support platforms 396 and 398. The lower support platforms are preferably integrally formed with the remaining upper support portion of each two-piece support assembly, designated 400 and 402. It will be appreciated that this principle may apply to any of the embodiments described herein.

Another feature of the present invention that may apply to any embodiment described herein is the use of one or more manholes to provide access to the interior of the reservoir 352. In the embodiment shown in FIG. 12, five manholes are shown at 404, 406, 408, 410 and 412. The manholes may be covered by any suitable means, such as through covers 414, 416, 418, 420 and 422. The manhole covers are typically secured by bolting. Any of the manhole covers may include an attached porthole, such as that shown at 424, for direct access from above ground. The manholes allow for any repairs of the reservoir that may become necessary, and also provide a means for locating ports for the connection of the various distribution and venting lines to the reservoir 352. The manholes are typically from 18 to 36 inches diameter, depending upon the particular need. As may be the case for any embodiment shown herein, the various distribution and venting lines may preferably be connected to the reservoir 352 through a bunghole located upon the upper surface of the reservoir 352 or upon any of the manhole covers, such as that referenced at 426.

Figure 13:
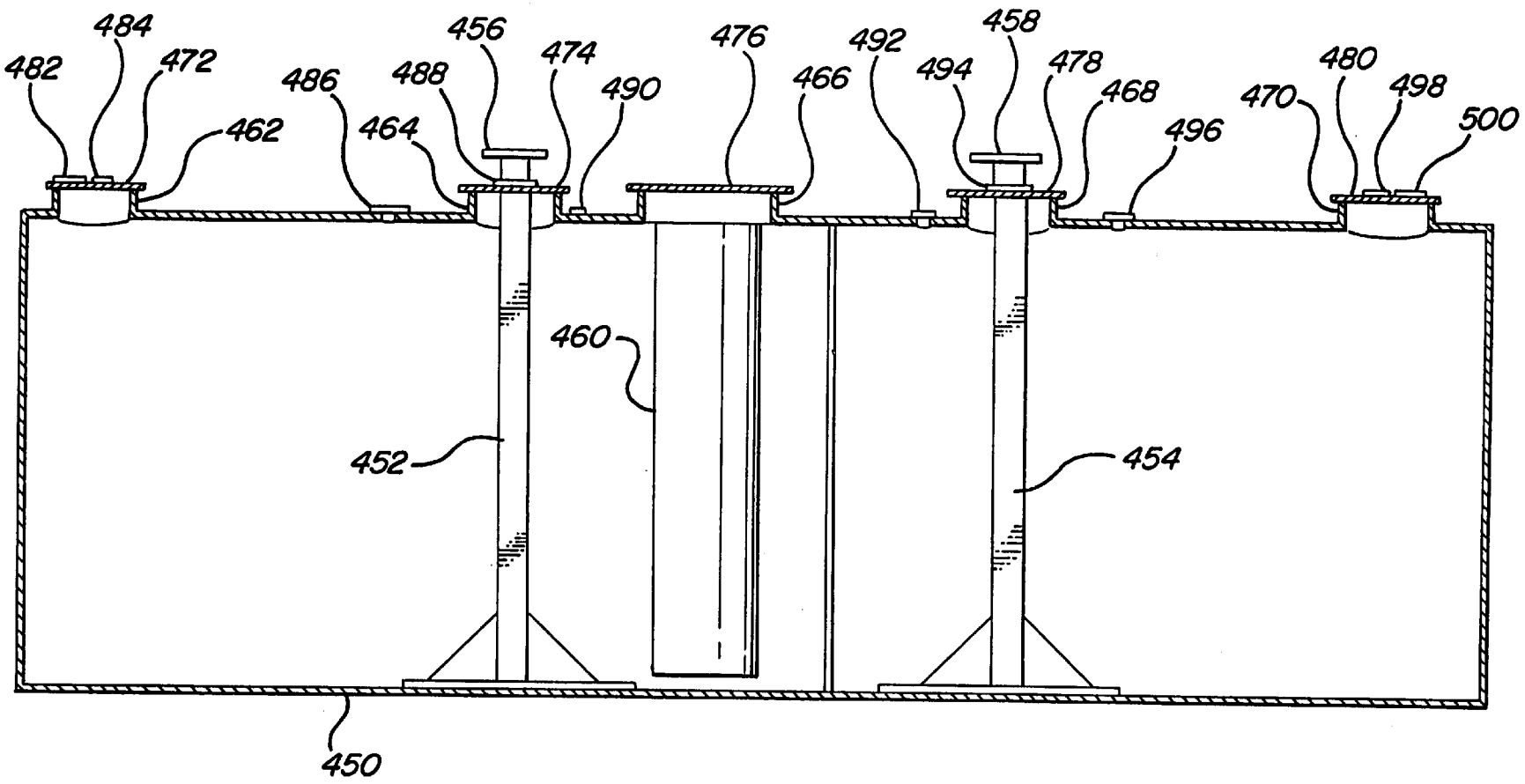
FIG. 13 is a cross-sectional view illustrating an underground storage reservoir in a pre-constructed form suitable for on-site installation below ground level.

Yet another preferred embodiment of the present invention is shown in FIG. 13. This figure shows a storage reservoir 450, which may be of the type shown in any of the embodiments previously described. The storage reservoir 450 is shown in the condition following manufacture, for delivery to a service station or other site for in-ground installation. Thus, the storage reservoir 450 can be provided in this condition, ready for installation in an excavated pit, and ready for the connection of all of the previously-described features of the integrated system at the locations provided.

To summarize, the storage reservoir 450 is provided with support units 452 and 454 which are preferably secured to the reservoir wall. The support units 452 and 454 include support covers 456 and 458, for the direct attachment of upper portions of the support units corresponding to the canopy system as previously described. The reservoir 450 includes an oil-water separator 460. Manholes are provided at 462, 464, 466, 468 and 470, for accessing the interior of the reservoir 450. Manhole covers are provided at 472, 474, 476, 478 and 480, for substantially closing the manholes. In addition, multiple bungholes are provided at 482, 484, 486, 490, 492, 496, 498 and 500, for the connection of the various support units, dispensing and venting lines and filling and vapor recovery lines. Welds are also provided at 488 and 494 for enhancing the engagement of the support units 452 and 454 with the manhole covers 474 and 478.

While the above description discusses preferred embodiments of the present invention, it will be understood that the description is exemplary in nature and is not intended to limit the scope of the invention. The present invention will therefore be understood as susceptible to modification, alteration and variation by those skilled in the art without deviating from the scope and meaning of the following claims.

What is claimed is:

1. An integrated underground storage reservoir and above-ground canopy system comprising:

a storage reservoir suitable for being buried beneath ground level, said storage reservoir suitable for containing a fluid;

a support system having a portion disposed within said reservoir and connected to said reservoir said support system being suitable for projecting above ground level when said reservoir is in a buried condition;

an above-ground canopy attached to said support system, said canopy being suitable for providing shelter from weather while accessing said reservoir, said support system being operable for supporting said canopy in an above-ground position;

a delivery system for delivery of said fluid from within said reservoir to above ground level; and an above-ground distribution system for distribution of fluid from said delivery system, at least portion of said distribution system being disposed within said canopy.

2. The integrated system according to claim 1, wherein said support system comprises at least one support unit having lower and upper support portions, said lower support portion suitable for being attached to said reservoir prior to installation of said reservoir beneath ground level, said upper support portion suitable for being attached to said lower support portion for supporting said canopy.

3. The integrated system according to claim 2, wherein at least one support unit includes means for engaging an external surface of said reservoir.

4. The integrated system according to claim 3, wherein said means for engaging an external surface of said reservoir comprises a bearing plate.

5. The integrated system according to claim 2, wherein at least one support unit includes means for engaging an internal surface of said reservoir.

6. The integrated system according to claim 5, wherein said means for engaging an internal surface of said reservoir comprises a bearing plate.

7. The integrated system according to claim 2, wherein at least one support unit includes a first bearing plate disposed to engage an external surface of said reservoir and a second bearing plate disposed to engage an internal surface of said reservoir.

8. The integrated system according to claim 7, wherein said first bearing plate engages an upper external surface of said reservoir and said second bearing plate engages a lower internal surface of said reservoir.

9. The integrated system according to claim 1, wherein said reservoir is suitable for storing automobile fuel.

10. The integrated system according to claim 1, wherein at least a portion of said distribution system is disposed upon said support system.

11. The integrated system according to claim 1, wherein said distribution system is operable to distribute automobile fuel to at least one fuel dispensing unit.

12. The integrated system according to claim 11, wherein at least a portion of said distribution system is disposed upon at least one fuel dispensing unit.

13. The system according to claim 1, wherein said support system further comprises a second canopy.

14. The integrated system according to claim 13, wherein at least a portion of said distribution system is disposed upon said second canopy.

15. The system according to claim 1, further comprising at least one additional storage reservoir.

16. The system according to claim 1, further comprising at least one additional support structure disposed between said canopy and the ground.

17. The integrated system according to claim 1, further comprising a plurality of distribution units disposed upon a plurality of service islands, wherein at least a portion of said distribution system extends upon said canopy for delivering fluid to each distribution unit upon each service island.

18. A storage reservoir and support assembly comprising:

a storage reservoir suitable for containing a fluid and suitable for being buried below ground level;

a support portion having a section thereof disposed within said storage reservoir and attached to said storage reservoir for supporting an above-ground canopy, said support portion being suitable for being at least partially buried below around level and projecting above ground level for attachment to at least one of a canopy any a complementary support extension portion attached to a canopy.

* * * * *

UNITED STATES PATENT AND TRADEMARK OFFICE

CERTIFICATE OF CORRECTION

PATENT NO. : 5,921,712
DATED : July 13, 1999
INVENTOR(S) : Albert L. Wokas

It is certified that error appears in the above-identified patent and that said Letters Patent is hereby corrected as shown below:

Column 16,
Line 10, "any" should be -- and --.

Signed and Sealed this

Thirtieth Day of April, 2002

*Attest:*

*Attesting Officer*

JAMES E. ROGAN
*Director of the United States Patent and Trademark Office*